US012123204B2

(12) United States Patent
Fahle

(10) Patent No.: US 12,123,204 B2
(45) Date of Patent: Oct. 22, 2024

(54) PANELS WITH A DETACHABLE PROTRUDING LIP FOR WALL-, CEILING- OR FLOOR COVERINGS

(71) Applicant: Lignum Technologies AG, Niederteufen (CH)

(72) Inventor: Daniel Fahle, Dresden (DE)

(73) Assignee: Lignum Technologies AG, Niederteufen (CH)

( * ) Notice: Subject to any disclaimer, the term of this patent is extended or adjusted under 35 U.S.C. 154(b) by 0 days.

(21) Appl. No.: 17/768,403

(22) PCT Filed: Nov. 7, 2019

(86) PCT No.: PCT/EP2019/080535

§ 371 (c)(1),
(2) Date: Apr. 12, 2022

(87) PCT Pub. No.: WO2021/089152

PCT Pub. Date: May 14, 2021

(65) Prior Publication Data

US 2024/0125129 A1 Apr. 18, 2024

(51) Int. Cl.

| | |
|---|---|
| ***E05F 15/00*** | (2015.01) |
| ***E04F 13/08*** | (2006.01) |
| ***E04F 15/02*** | (2006.01) |

(52) U.S. Cl.

CPC .... *E04F 15/02038* (2013.01); *E04F 13/0894* (2013.01); *E04F 2201/0146* (2013.01); *E04F 2201/023* (2013.01); *E04F 2201/042* (2013.01); *E04F 2201/043* (2013.01); *E04F 2290/00* (2013.01)

(58) Field of Classification Search

CPC ..... E04F 15/02038; E04F 15/02033; E04F 13/0894; E04F 15/107; E04F 2201/0138; E04F 2201/0153; E04F 2201/042; E04F 2201/043; E04F 2201/0146; E04F 2201/023; E04F 2290/00; B32B 3/06; B32B 21/02; B32B 37/10; B32B 38/0004; B32B 38/105; B32B 2471/00; B32B 2307/584; B32B 2451/00

See application file for complete search history.

(56) References Cited

U.S. PATENT DOCUMENTS 3,538,660 A 11/1970 Moor
6,101,778 A 8/2000 Martensson
(Continued)

FOREIGN PATENT DOCUMENTS

CN 1203649 A 12/1998
CN 1656291 A 8/2005
(Continued)

OTHER PUBLICATIONS

U.S. Appl. No. 16/469,522, filed Dec. 23, 2016, Bircham.
(Continued)

*Primary Examiner* — Chi Q Nguyen
(74) *Attorney, Agent, or Firm* — Crowell & Moring LLP

(57) ABSTRACT

A panel with a detachable protruding lip for wall, ceiling or floor coverings is provided. Furthermore, methods are provided for manufacturing wall, ceiling or floor coverings comprising or consisting of a plurality of the panels.

20 Claims, 2 Drawing Sheets

(56) References Cited

U.S. PATENT DOCUMENTS

| | | | | |
|---|---|---|---|---|
| 6,421,970 | B1 | 7/2002 | Martensson | |
| 6,446,405 | B1 | 9/2002 | Pervan | |
| 6,685,391 | B1 | 2/2004 | Gideon | |
| 7,131,242 | B2 | 11/2006 | Martensson | |
| 7,726,088 | B2 | 6/2010 | Muehlebach | |
| 7,980,039 | B2 | 7/2011 | Groeke | |
| 8,029,880 | B2 | 10/2011 | Liu | |
| 8,091,238 | B2 | 1/2012 | Hannig | |
| 8,302,367 | B2 | 11/2012 | Schulte | |
| 8,375,672 | B2 * | 2/2013 | Hannig | E04F 15/02038 52/591.1 |
| 8,720,150 | B2 * | 5/2014 | Hannig | E04F 13/0894 52/592.1 |
| 8,850,769 | B2 | 10/2014 | Pervan | |
| 9,314,936 | B2 | 4/2016 | Pervan | |
| 11,479,970 | B2 * | 10/2022 | Pervan | E04F 15/02038 |
| 11,702,848 | B2 * | 7/2023 | Boucké | E04F 15/102 52/588.1 |
| 11,834,844 | B2 * | 12/2023 | Perra | E04F 15/02038 |
| 2006/0073320 | A1 | 4/2006 | Pervan et al. | |
| 2009/0217615 | A1 | 9/2009 | Engstrom | |
| 2009/0249733 | A1 | 10/2009 | Moebus | |
| 2010/0031594 | A1 | 2/2010 | Liu et al. | |
| 2010/0043333 | A1 | 2/2010 | Hannig | |
| 2011/0167750 | A1 | 7/2011 | Pervan | |
| 2011/0271631 | A1 | 11/2011 | Engstrom | |
| 2011/0271632 | A1 | 11/2011 | Cappelle | |
| 2012/0042595 | A1 | 2/2012 | De Boe | |
| 2012/0180416 | A1 | 7/2012 | Perra | |
| 2013/0008118 | A1 * | 1/2013 | Baert | B29C 63/044 156/60 |
| 2013/0180193 | A1 | 7/2013 | Bossuyt | |
| 2013/0276398 | A1 | 10/2013 | Hannig | |
| 2013/0283720 | A1 * | 10/2013 | Pervan | E04F 15/02038 52/588.1 |
| 2013/0309441 | A1 | 11/2013 | Hannig | |
| 2014/0033633 | A1 * | 2/2014 | Kell | E04F 13/26 403/348 |
| 2015/0121793 | A1 * | 5/2015 | Segaert | B32B 5/024 52/506.01 |
| 2015/0240500 | A1 | 8/2015 | Stevens, Jr. | |
| 2015/0267418 | A1 | 9/2015 | Vermeulen | |
| 2016/0097204 | A1 * | 4/2016 | Meersseman | E04F 15/02033 52/316 |
| 2016/0177576 | A1 * | 6/2016 | Ramachandra | E04F 15/04 52/588.1 |
| 2019/0257092 | A1 | 8/2019 | De Rick et al. | |
| 2020/0131784 | A1 * | 4/2020 | Boucké | E04F 15/107 |
| 2020/0340254 | A1 * | 10/2020 | De Rick | E04F 15/107 |

FOREIGN PATENT DOCUMENTS

| | | | |
|---|---|---|---|
| CN | 101035627 | A | 9/2007 |
| CN | 101490346 | A | 7/2009 |
| CN | 103547749 | A | 1/2014 |
| CN | 103748299 | A | 4/2014 |
| CN | 106103862 | A | 11/2016 |
| DE | 196 01 322 | A1 | 5/1997 |
| EP | 1 279 778 | A2 | 1/2003 |
| EP | 1 650 375 | A1 | 4/2006 |
| EP | 1730366 | A1 | 12/2006 |
| WO | WO 97/21011 | | 6/1997 |
| WO | WO 97/47834 | A1 | 12/1997 |
| WO | WO 01/66877 | A1 | 9/2001 |
| WO | 1 282 752 | A1 | 11/2001 |
| WO | WO 03/025307 | A1 | 3/2003 |
| WO | WO 03/083234 | A1 | 10/2003 |
| WO | WO 2004/063491 | A1 | 7/2004 |
| WO | 1 730 366 | A1 | 10/2005 |
| WO | WO 2007/142589 | A1 | 12/2007 |
| WO | WO 2012/126046 | A1 | 9/2012 |
| WO | WO 2013/025165 | A1 | 2/2013 |
| WO | WO 2015/155312 | A1 | 10/2015 |
| WO | WO 2019/015746 | A1 | 1/2019 |

OTHER PUBLICATIONS

U.S. Appl. No. 16/470,086, filed Dec. 20, 2016, Fahle.
U.S. Appl. No. 16/632,151, filed Jul. 18, 2017, Fahle et al.
U.S. Appl. No. 16/757,699, filed Oct. 25, 2017, Dürnberger.
U.S. Appl. No. 16/759,580, filed Oct. 29, 2018, Heim et al.
U.S. Appl. No. 17/052,266, filed May 2, 2018, Speidel.
U.S. Appl. No. 17/052,274, filed May 2, 2018, Speidel.
U.S. Appl. No. 17/285,841, filed Oct. 17, 2018, Fahle.
International Search Report and Written Opinion for International Patent Application No. PCT/EP2019/080535 dated Sep. 16, 2020, 9 pages.
Second Chinese Office Action with English Translation for Chinese Patent Application No. 2017800933176, dated Aug. 3, 2021, pp. 1-8, China National Intellectual Property Administration, Beijing, People's Republic of China.
International Search Report and Written Opinion, issued in International Application No. PCT/EP2017/068140, dated Apr. 18, 2018, pp. 1-13, European Patent Office, Rijswijk, Netherlands.
Chinese Office Action with English translation, dated Dec. 17, 2020, pp. 1-20, Chinese Patent Application No. 201780093317.6, China National Intellectual Property Administration, Beijing, China.

* cited by examiner

PANELS WITH A DETACHABLE PROTRUDING LIP FOR WALL-, CEILING- OR FLOOR COVERINGS

CROSS-REFERENCE TO RELATED APPLICATIONS

This application is a 371 nationalization of international patent application PCT/EP2019/080535, filed on Nov. 7, 20219, the entire contents of which is hereby incorporated by reference.

TECHNICAL FIELD

The present disclosure relates to panels with a detachable protruding lip for wall, ceiling or floor coverings. Furthermore, it relates to a method for manufacturing wall, ceiling or floor coverings comprising or consisting of a plurality of such panels.

BACKGROUND

Panels for wall, ceiling or floor coverings are known in the art. EP 1 282 752 A1 relates to panels of a laminate floor, comprising coupling elements which enable a form-fitting connection between the panels. A first and a second panel have coupling elements on one side in each case, whereby the first panel can be connected form-fittingly to the second panel by a rotary movement. The first and second panels additionally have on a further side in each case coupling elements which are so configured that the second panel is connectable form-fittingly to the first panel by lowering said second panel with respect to the first panel. The first panel includes a projecting edge positioned laterally on its underside as an additional coupling element serving to connect the panels by lowering. The second panel includes a projecting edge positioned laterally on its upper side and serves to connect the panels by lowering, which projecting edge projects further in comparison to lateral portions of this panel located below said projecting edge. The projecting edge of the second panel has on its underside a first projecting locking element which in the assembled state of the two panels engages in a corresponding first recess in the projecting edge on the underside of the first panel. The first recess is openly accessible when the first panel rests with its underside on a floor. The two panels include further coupling elements serving to connect the panels by lowering, which lock the two panels form-fittingly in a vertical direction with respect to the surface of the panels. In the assembled state of the two panels the further coupling elements serving to join the panels by lowering are located below the edge projecting on the upper side. In the assembled state of the two panels a plurality of gaps between the coupling elements of the first and second panels serving to connect the panels by lowering are present at the locations which are not used for mechanical connection. The gaps are provided between the coupling elements in such a way that no free play remains at the connecting joint between the two panels.

WO 97/047834 A1 refers to a floor covering, consisting of hard floor panels which, at least at the edges of two opposite sides, are provided with coupling parts, cooperating with each other, substantially in the form of a tongue and a groove, characterized in that the coupling parts are provided with integrated mechanical locking means which prevent the drifting apart of two coupled floor panels into a direction perpendicular to the related edges and parallel to the underside of the coupled floor panels.

WO 03/025307 A1 relates to floorboards for installation of floors in herringbone pattern which are formed with two opposite sides inverted relative to each other.

WO 04/63491 A1 refers to a floor covering, of the type consisting of hard floor panels, which are manufactured of a plate material and which, at least at a number of sides, are provided with coupling parts, characterized in that the floor panels are configured such that, in joined condition, they represent a herringbone pattern, whereby the sides of the floor panels coincide with transition edges of the herringbone pattern.

WO 01/066877 A1 relates to a vertically joined flooring material comprising floor elements with a mainly triangular, square, rectangular, rhomboidal or polygonal shape. The floor elements are provided with edges which are provided with joining members, a lower side and a decorative top surface. The flooring material comprises a combination of at least two types of floor elements, which types comprise female floor elements and male floor elements. The female floor element is provided with a female joining member on at least half of the number of its edges and a male joining member on less than half of the number of its edges. The male floor element is provided with a male joining member on at least two thirds of the number of its edges and a female joining member on less than one third of the number of its edges. An optional joining profile possibly constitutes a junction between two adjacent male joining members of two adjacent floor elements.

WO2007/142589 A1 refers to a connection member for massive dynamic bodies comprising a longitudinal body having a cross section that includes two base plates aligned in opposite directions adapted to extend along the bottom sides of two adjacent dynamic bodies, wherein the base plates are provided with projections directed upwards; an upright shank with two shank legs, the shank legs transforming into the respective base plates; two spring arms extending out from the upper body of the shank essentially parallel to the base plates, wherein the spring arms are bent upwards and bent inwards towards the shank such that a lower section is essentially parallel to an upper section, each respective upper section of the spring arms being provided with a projection directed upwards; and a supporting head arranged on top of the upper body of the shank in a mounted position, and a method of connecting dynamic bodies such as wood pieces where at least two wood pieces having circumferential recesses are connected to at least one connecting member.

US 2010/0031594 A1 relates to a hardwood floor system with press down locking mechanism. Each floor board is equipped with both male and female locking mechanisms. The male locking mechanism of a floor bard can be locked into the female locking mechanism of an adjacent floor board by simply exerting downward force on the floor board. The female locking mechanism is equipped with a spring slot that enables easy engagement of male and female locking mechanisms.

EP 1 730 366 A1 refers to a panel element for laying on floors, walls and/or ceilings, comprising a rectangular basic body. The basic body has a first head edge, a second head edge opposed to the first head edge, a first longitudinal edge extending perpendicularly to the first head edge, and a second longitudinal edge opposed to the first longitudinal edge. Both head edges and both longitudinal edges are contoured so as to allow a connection with an adjacent panel element at each edge, and wherein the first longitudinal edge has a groove and the second longitudinal edge has a corresponding tongue. A shorter upper leg and longer lower leg are provided on the first longitudinal edge, wherein the contours of the head edges each have an undercut so as to allow an engagement of the tongue of the second longitudinal edge in the contour of each head edge of an adjacent, identical panel element. A step is provided on each head edge adjoining the undercut and an engagement facility is provided between the lower leg of the first longitudinal edge and the step so as to allow a connection between the groove of the first longitudinal edge and each head edge of an adjacent, identical panel element.

WO 2019/015746 describes a panel for wall, ceiling or floor coverings with a detachable protruding lip, allowing for a flexible installation of the panels with respect to each other. In these panels, separate vertical locking elements need to be inserted in e.g. locking grooves. These separate locking elements are difficult to install; on the other hand side, the separate lacking elements are likely to be forgotten during installation, so that in the latter case, no additional vertical security of the panels with respect to each other is given.

SUMMARY

The panel elements known in the prior art have the disadvantage that especially for herringbone patterns they provide little or no locking at all in a vertical direction away from laying the plane. Often locking systems are employed on rather thin panels, so that complicated machining of delicate profile elements with many undercuts is difficult and expensive and delicate locking elements are often damaged and deformed, especially when they are used for flooring.

Based thereon, the objective of the present disclosure was the provision of a panel with a locking system which is stable in locking, simple to manufacture with only a low risk for damaging the locking elements, allows for easy and interesting installations and allows laying any desired pattern.

This objective is achieved by a panel for wall, ceiling or floor coverings. This panel comprises an upper side, a lower side, and front ends, defining a circumference of the panel in the installed state and at least one front is protruded with respect to the circumference by a detachable protruding lip formed at the lower side, one horizontal locking groove at the lower side, characterized in that the protruding lip has a predetermined break-off surface.

Another aspect relates to a method for manufacturing wall, ceiling and/or floor coverings comprising or consisting of a plurality of panels. According to said method, a first panel at its front end is connected with the corresponding front end of the neighbored panel by removing the protruding lip at the predetermined break-off surface and by joining the protruding lip of the first panel with the neighbored panel.

Furthermore, another aspect is that the front ends of the four sides of the panel have different joint profiles.

On the pair of opposing first sides, two female locking elements, i.e. an upper and a lower female locking element are present on the front ends.

The additional opposing second sides have an individual joint profile at their front ends. The first second side comprises an upper male locking element and a lower female locking element, whereas the second side comprises a upper female locking element and a lower male locking element at the respective front end.

When joining pairs of the panels, an individual fitting or alignment of two separate panels is possible by removing the detachable protruding lip in one panel and joining it with the neighboring panel (wherein the protruding lip is present). Especially if the panel is installed with its second side to a neighboring panel (either at its first side or second side) a secure locking at the front ends by means of the locking elements provided on the front ends is possible.

PREFERRED EMBODIMENTS

Panel

In general, panels are quadrilateral and preferably are rectangular, quadratical or have the shape of a parallelogram and especially have a regular shape. In the gist of present disclosure regular shapes have sides that are all equal and interior (inside) angles that are all equal, whereas irregular shapes have sides and angles of any length and size. The disclosure is not limited to rectangular panels having a regular shape, but the inventive concept is also applicable to panels having an irregular shape.

Preferably, the female locking elements provided on the front ends are provided as grooves, whereas the male locking elements are configured as protrusions. In one embodiment, the protrusions can be inserted in a form-fit manner in the grooves. In any case, when the protrusions are inserted into the grooves, a vertical locking takes place.

Preferably, the first sides of the panel are the long sides, e.g. of a rectangular panel, whereas the second sides of the panel are the short sides.

According to one preferred embodiment of the present disclosure, the predetermined break-off surface is formed by one or more start notches, one or more cuttings, preferably laser cuttings, one or more drillings, one or more milled slots, a density gradient within the panel, by means of introducing a film, adhesives, binders and/or primers and/or by using different materials in the area of the predetermined break-off surface.

According to another preferred embodiment of the present disclosure, the the protruding lip comprises at least one horizontal locking element, being suitable for engaging in the horizontal locking groove of a neighbored panel, wherein the protruding lip of said neighbored panel has been removed. A horizontal locking element in the spirit of the present disclosure has a locking effect in horizontal direction, whereas a vertical locking element has a locking effect in vertical direction. According to the present disclosure, the horizontal direction is the laying direction of the panels and the vertical direction is the direction at right angle to the laying direction.

A further preferred embodiment of the present disclosure envisages that at least two detachable protruding lips are fixed at the panel, more preferably at opposite sides of the panel.

Especially, the panel has four sides and is rectangular and detachable protruding lips are fixed at all four sides of the panel, i.e. all front ends are protruded with respect to the circumference by a detachable protruding lip formed at the lower side.

According to a further preferred embodiment of the present disclosure, the horizontal locking element additionally retains the neighbored panel in vertical and/or horizontal direction.

According to a further preferred embodiment of the present disclosure, the panel comprises, preferably consists of, a material selected from the group consisting of MDF (=medium density fiber board), HDF (=high density fiber board), cork, OSB (=oriented strand board), solid wood, plywood, plastics, preferably PVC (=polyvinylidene chloride), cement fibers, basalt, rock wool, ceramics, genuine stone, metal, preferably aluminum or steel panel, plastics, chipboard, laminate floorboards and mixtures or pairings thereof.

Another preferred embodiment of the present disclosure envisages that the panel consists of laminate floorboards made of MDF or HDF or PVC or mixtures thereof. In case that PVC is used it is preferable that the PVC is free of softeners.

A further preferred embodiment envisages that a vertical locking groove is incorporated in the horizontal locking groove and the protruding lip comprises a vertical locking element being suitable for engaging in the vertical locking groove of a neighbored panel, wherein the protruding lip of said neighbored panel has been removed.

According to a further preferred embodiment, the protruding lip comprises a trough. Said embodiment is in particular preferred when joining is carried out by applying an adhesive or a glue. The trough is suitable for the accommodation of the adhesive or the glue and since the user can dose the amount of the adhesive or glue, oozing of said adhesive or glue oozes over the edges during the joining process is prevented. Furthermore, it is possible to fix a double-sided adhesive in the trough during the manufacturing process of the protruding lip.

According to another preferred embodiment, the predetermined break-off surface is formed by one start notch and one end notch. Said embodiment is in particular preferred when the panel with the protruding lip both consists of MDF or HDF. The one end notch is preferably arranged in the horizontal locking groove.

Another preferred embodiment envisages that the panel has a rectangular shape. For a rectangular shape the length of the panel is an integer multiple of the width, such as 1:1, 1:2, 1:3, 1:4, 1:5, 1:6, 1:7, 1:8, 1:9, 1:10, 1:11, 1:12 etc., preferably 1:6. For other ratios between length and width a herringbone pattern cannot be obtained.

According to a further preferred embodiment, the protruding lip comprises a trough, more preferably said through comprises a double-sided adhesive tape.

According to another preferred embodiment, the protruding lip and the core of the panel consist of different materials. Cheap materials like e.g. plastics are preferred for the protruding lip. In one preferred embodiment the protruding lip comprises, preferably consists of a material selected from the group consisting of MDF, HDF or plastics and the core comprises, preferably consists of a material selected from the group consisting of MDF, HDF or plastics, preferably PVC more preferably the protruding lip consists of plastic and the core consists of MDF or HDF or PVC or mixtures thereof.

Another preferred embodiment of the present disclosure envisages that the bend surface of the protruding lip is beveled. This embodiment has the advantage that the risk of damaging the panel during the laying process is reduced.

According to another preferred embodiment, the start notch is oriented in a vertical distance in the range from 0.1 to 10 mm above the upper lip surface for forming a crack gap. Said crack gap can accommodate any irregular break off surface.

According to another preferred embodiment, a decorative layer and/or an abrasion resistant layer is arranged on the upper side.

Another preferred embodiment envisages that a layer for insulating footstep sounds and/or a counterdraw layer is oriented below the lower side. More preferably the panel comprises an abrasion resistant layer, a decorative layer, a counterdraw layer and a layer for insulating footstep sounds.

The protruding lip can in principle be fixed to the panel by all fixing techniques known in the arts, preferably by gluing or adhering.

Methods

The present disclosure furthermore relates to a method for manufacturing wall, ceiling and/or floor coverings consisting of a plurality of panels. The wall, ceiling and/or floor covering is made of a plurality of panels and said panels are laid during the manufacturing process of the panel.

According to the first method, the locking function in vertical direction is achieved by mechanical means, whereas no mechanical means are required for locking in vertical direction by the second method.

First Method

According to one preferred embodiment of the first method according to the present disclosure, the protruding lip of the first panel comprises at least one horizontal locking element being suitable for engagement in the horizontal locking groove of the neighbored panel, whose protruding lip has been removed, wherein during joining the horizontal locking groove is incorporated in the horizontal locking groove.

According to a further preferred embodiment of the present disclosure, the first panel and the neighbored panel each have a vertical locking groove at their front end and during joining an insertable locking element connecting the vertical locking grooves is introduced in the vertical locking grooves.

Second Method

According to a preferred embodiment of the present disclosure, no mechanical means are provided for locking in the vertical direction. In this embodiment the protruding lip preferably comprises a trough for the accommodation of an adhesive or the through comprises a double-sided adhesive tape.

Independent on the method chosen for laying the panel, there is no limitation regarding the laying pattern. Both methods allow laying the panels parallels to each other or laying the panels vertically to each other, as needed for herringbone patterns or other complex patterns.

BRIEF DESCRIPTION OF THE DRAWINGS

Preferred embodiments of the disclosure are described in the following with reference to the drawings, which are for the purpose of illustrating the present preferred embodiments of the disclosure and not for the purpose of limiting the same.

LIST OF REFERENCE SIGNS

Figure 1:
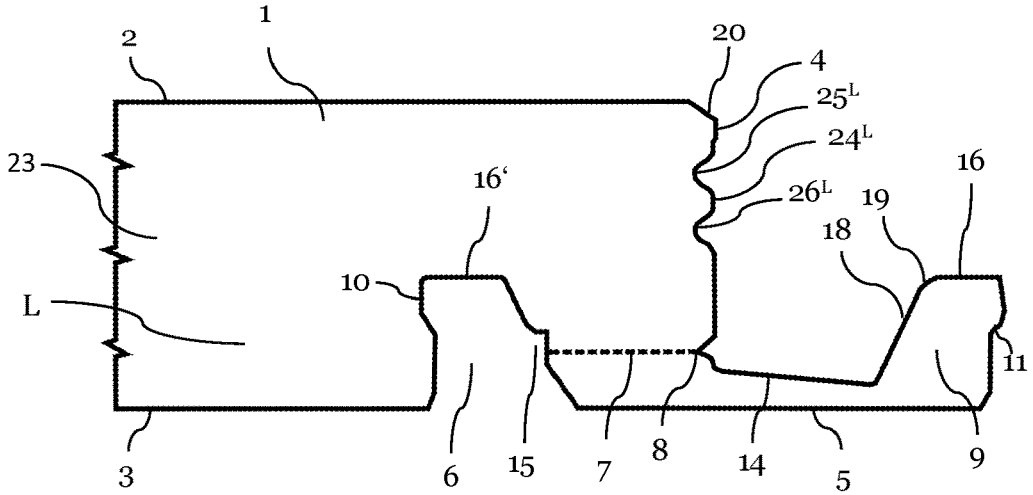

1, 1': Panel
2, 2': Upper side of the panel
3, 3': Lower side of the panel
4: Front end of the panel
5: Protruding lip
6: Horizontal locking groove
7, 7': Predetermined break-off surface
8: Start notch

9: Horizontal locking element
10: Distal vertical locking groove
11: Distal vertical locking element
13: Crack gap
14: Upper lip surface
15: End notch
16, 16': Abutment surface
18: Locking surface
19: Guiding surface
20: Decorative bevel
23: Core of the panel
24: Joint profile
25: Upper half of joint profile
26: Lower half of joint profile FIG. 1 shows a side view of a long side panel (1) profile with a detachable protruding lip (5) according to the present disclosure.

Figure 2:
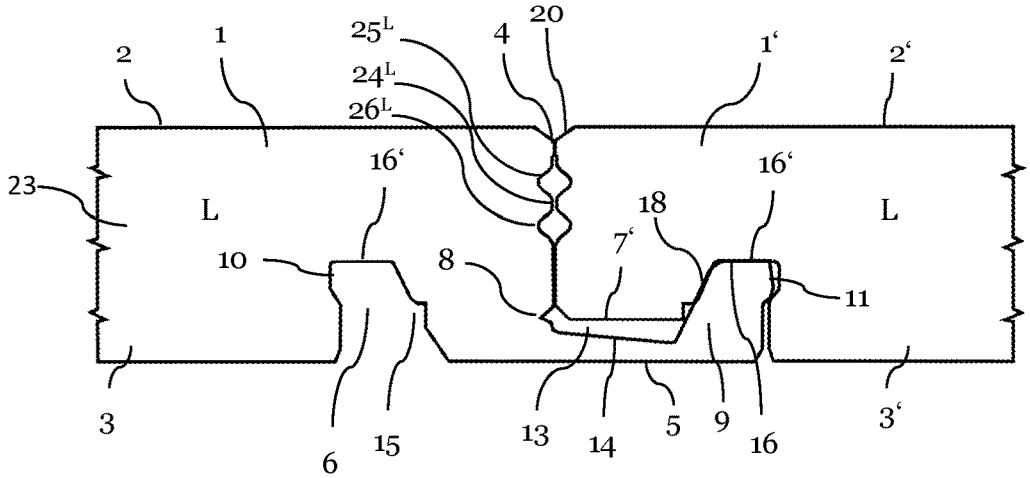

FIG. 2 shows a side view of two long side panel (1, 1') profiles in the coupled condition according to the disclosure. The lower lip (5) of the right hand panel (1') has been detached.

Figure 3:
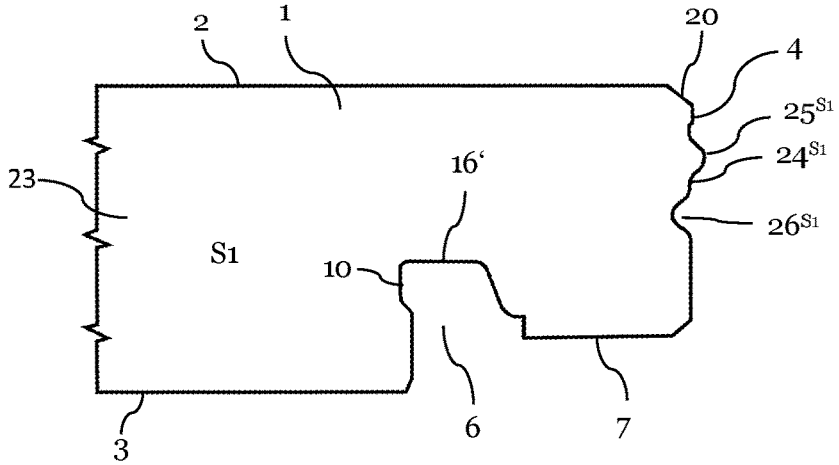

FIG. 3 FIG. 3 shows a side view of a panel (1) first short side profile according to the disclosure, of which the lower lip (5) has been detached.

Figure 4:
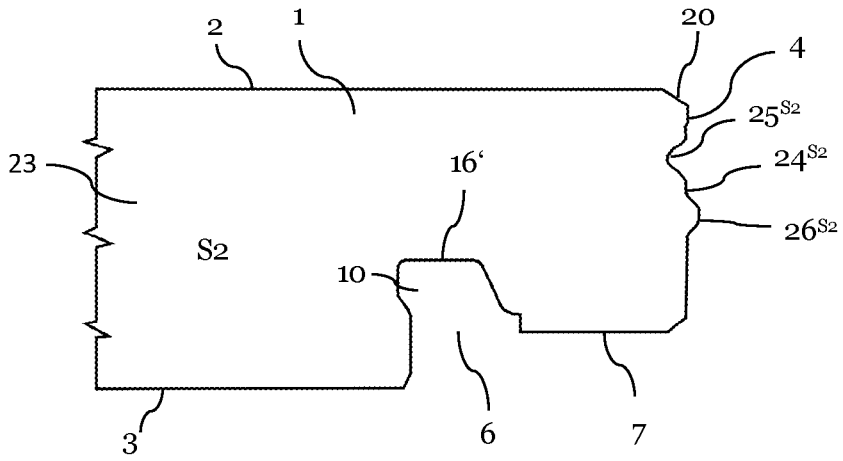

FIG. 4 shows side view of a panel (1) second short side profile according to the disclosure, of which the lower lip (5) has been detached.

Figure 5:
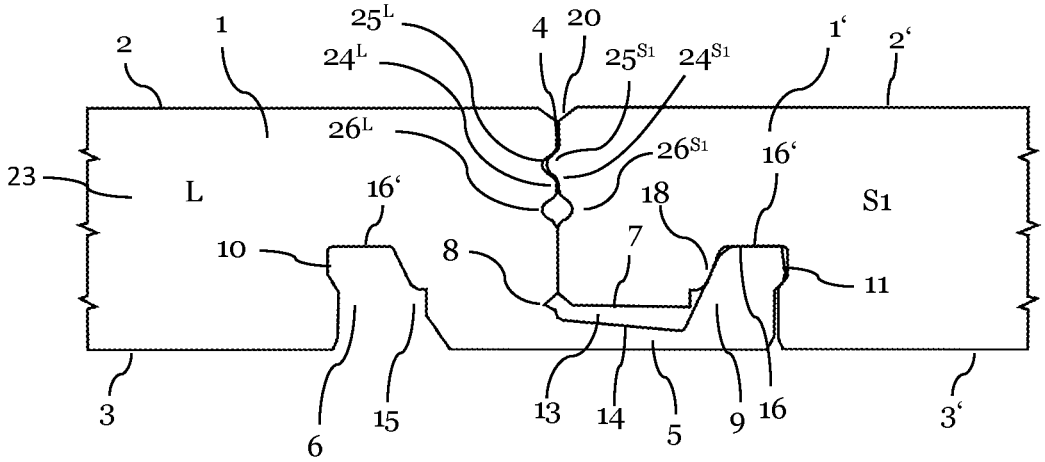

FIG. 5 shows a side view of a long side panel (1) profile and a first short side panel (1') profile in the coupled condition according to the disclosure. The lower lip (5) of the right hand panel (1') has been detached.

Figure 6:
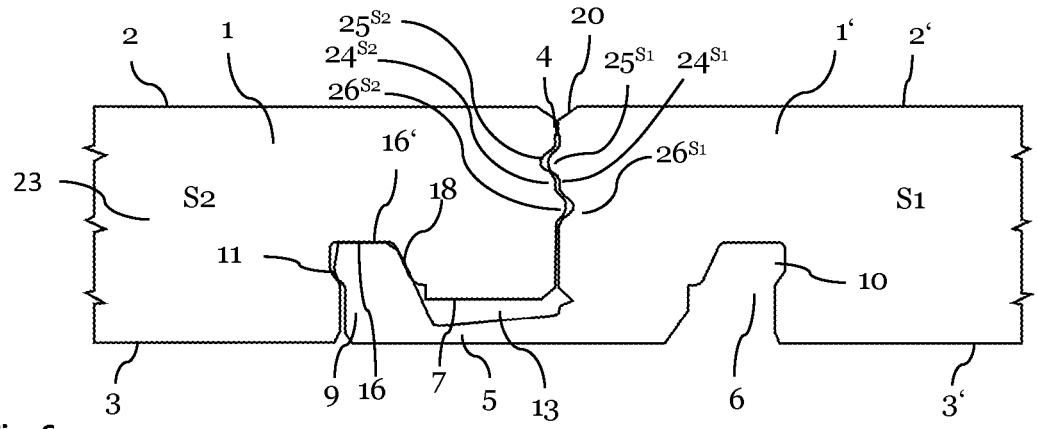

FIG. 6 shows a side view of a second short side panel (1) profile and a first short side panel (1') profile in the coupled condition according to the disclosure. The lower lip (5) of the left hand panel (1) has been detached.

DESCRIPTION OF PREFERRED EMBODIMENTS

FIG. 1 displays a panel according to the present disclosure, a section through a long side (L) is shown. The panel (1) has a core (23), a horizontal locking groove (6) along with a distal vertical locking groove (10) and a detachable protruding lip (5). A horizontal locking element (9) is mounted on a protruding lip (5). The horizontal locking element is designed in such a way, that it fits into a horizontal locking groove (6) of a neighboring panel (1', not shown in FIG. 1) and thereby provides locking in a horizontal direction. The panel (1) has an upper side (2), which may or may not be decorated or covered by an additional abrasion resistant surface. Furthermore, the panel (1) may or may not have a decorative bevel (20) at its edge. With the embodiment shown in FIG. 1, a start notch (8) is created in the panel (1). By applying a downward force at the end of the protruding lip (5), for example by applying a downward pressure by hand on the abutment surface (16), a lever is created by the protruding lip (5). This lever is further lengthened by the start notch (8) which thereby acts as starting point for a crack. This crack intentionally propagates from the start notch (8) to an end notch surface (15).

The protruding lip (5) comprises a horizontal locking element (9), on which distal vertical locking element (11) is present. The horizontal locking element (9) can engage with a horizontal locking groove (6) as well as a distal vertical locking groove (10) of a neighboring panel (1', not shown), in which the protruding lip (5) has been detached along the predetermined break-off surface (7).

According to the present disclosure, the front end (4) of a long side (L) of the panel (1) according to the present disclosure comprises a joint profile (20, which consists of a upper locking element, i.e. a upper female locking element (25') and a lower locking element, i.e. a lower female locking element ($26^L$).

FIG. 2 shows a side view of two long side panel (1, 1') profiles in the coupled condition according to the disclosure. The lower lip (5) of the right hand panel (1') has been detached by propagating a crack beginning form the start notch (8) and ending in the end notch (15) whereby a predetermined break-off surface (7') has been formed.

When two panels (1, 1') are aligned along their long side as shown in FIG. 2, the horizontal locking element (9) ensures both a horizontal and vertical locking of the respective neighboring panels (1, 1'). The locking surface (18) ensures a horizontal fixing of the panels (1,1') with respect to each other, the guiding surface (19) enables the secure gliding of the second panel (1') into the locking mechanism to ensure that the protruding lip (5) is not detached. Furthermore, a vertical locking element (11), when engaged with the vertical locking groove (10) also hinders vertical displacement panels (1, 1') with respect to each other. Due to the fact that the long sides of the panels (1, 1') are installed with each other, the vertical locking is sufficient, so that no additional vertical locking, such as e.g. with the joint profile (24) is necessary.

In the embodiment of FIG. 2, vertical locking is additionally achieved in the following manner:

Firstly, vertical locking against a movement of both panels (1,1') towards the lower side of the panels (3,3') is prevented by the substrate onto which the panels (1,1') are mounted, which is the floor, the wall, the ceiling or any further coverings thereof.

Secondly, vertical locking against a movement of the second panel (1') towards the lower side if the panel (3') is prevented by the abutment surfaces (16,16').

It is clear that with the many different types of possible materials or material combinations out of which the panels (1) according to the disclosure can be made, it cannot be expected that the predetermined break-off surface (7) is always a smooth and straight, perfect surface. For panel materials such as e.g. wood based fiber boards known as MDF/HDF laminate, a generally irregular break-off surface (7) is rather to be expected. The geometry of the break off surface (7) can only be predetermined within limits. This is why it is important to choose the start notch (8) at some vertical distance above the upper lip surface (14). By this measure, a crack gap (13) is achieved, which can accommodate any irregular break off surface (7). This is important in that only the abutment surfaces (16, 16') are intended to touch in the horizontal plane and not the upper lip surface (14) somewhere at the irregular break-off surface (7), as this would result in panels which have their respective upper sides (2, 2') in different planes thereby resulting in an irregular paneled surface. It is also important to add a well defined end notch surface (15) into which the crack will exit because it enables the crack to travel the shortest available distance. A slightly inclined contact surface (18) is chosen, which enables horizontal locking. The inclination of the locking surface (18) enables to pull two panels (1, 1') towards each other in the final laying stage and is chosen to be 40 to 80 degrees to laying plane. A further inclined surface on the horizontal locking element (9) between the locking surface (18) and the abutment surface (16) additionally also serves as a guiding surface (19) to help to align the panels during laying.

FIG. 3 shows a section through a front end (4) of the first short side (S1) of a panel (1) according to the present disclosure. The protruding lip (5) already has been detached along the break-off surface (7). It becomes apparent that the joint profile (24) of the panel (1) along its first short side (S1) is shaped differently than along the long sides (L) as shown above in FIG. 1. The joint profile of the first short side ($\mathbf{24}^{S1}$) encompasses an upper male locking element ($\mathbf{25}^{S1}$) as well as well as a lower female locking element ($\mathbf{26}^{S1}$).

FIG. 4 shows the front end (4) of the opposite short side (S2) of the first side (S1) of a panel (1) according to the present disclosure. The joint profile (24) of the panel (1) along its second short side (S2) has the opposite configuration as the joint profile (24) of the first short side (S1). At the second short side (S2), the joint profile ($\mathbf{24}^{S1}$) has an upper female locking elements ($\mathbf{25}^{S1}$) as well as a lower male locking element ($\mathbf{26}^{S2}$).

Accordingly, the panels (1) according to the present disclosure have different joint profiles (24) at their short sides (S1, S2), which in addition is different from the joint profile (24) at their long side (L).

FIG. 5 shows the joining of panel (1) of the present disclosure along its long side (L) with a second panel (1') of the present disclosure along its first short side (S1).

It becomes apparent that the joint profile (24) of both panels (1, 1') allows an alignment of the both panels (1, 1') in virtually every combination. The protruding lip (5) of the second panel (1') has been removed. The upper male locking element (25 S1) of the first side (S1) of the second panel (1') engages with the upper female locking elements ($\mathbf{25}^{L}$) of the long side (L) of the first panel (1) contributing additionally to a vertical locking which already has been provided by the distal vertical locking element (11) and the distal vertical locking groove (10).

In the same manner, also a second side (S2) of the second panel (1') can be aligned with the long side (L) of the first panel (1) (not shown), with the only difference that the male locking element would in this case be the lower locking element (26), engaging with the lower female locking groove ($\mathbf{26}^{L}$) of the first panel (1).

FIG. 6 shows an embodiment in which two panels (1, 1'), according to the present disclosure, are installed along their short side (S1, S2). The inverse locking profile (24) being provided at the respective opposite short sides (S1, S2) allows complete engagement of the male locking elements with the female locking elements of the respective other panel. Accordingly, the panels can be secured vertically when installed along their short sides (S1, S2).

To clarify the use of and to hereby provide notice to the public, the phrases "at least one of <A>, <B>, . . . and <N>" or "at least one of <A>, <B>, . . . or <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one ore more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

The invention claimed is:

1. A panel for wall, ceiling or floor coverings with a quadrilateral shape, the panel comprising:

an upper side, a lower side, a pair of opposing first sides and a pair of opposing second sides, a first second side and a second second side and front ends, defining a circumference of the panel in an installed state, at least one front end is protruded with respect to the circumference by a detachable protruding lip having a predetermined break-off surface formed at the lower side, and a horizontal locking groove at the lower side, wherein the front ends of the first sides comprise a first joint profile with an upper female locking element and a lower female locking element, wherein the front end of the first second side comprises a first second joint profile with an upper male locking element adapted to engage with the upper female locking element of the first sides and/or an upper female locking element of the second second side; and, a lower female locking element, and the front end of the second second side comprises a second second joint profile with an upper female locking element and a lower male locking element adapted to engage with the lower female locking element of the first sides and/or the lower female locking element of the first second side.

2. The panel of claim 1 wherein the female locking elements are configured as grooves and/or the male locking elements are configured as protrusions.

3. The panel of claim 1 wherein the predetermined break-off surface is formed by one or more start notches, one or more cuttings, one or more drillings, one or more milled slots, a density gradient within the panel, by introducing a film, adhesives, binders and/or primers and/or by using different materials in the area of the predetermined break-off surface.

4. The panel of claim 1 wherein the protruding lip comprises at least one horizontal locking element, configured to engage the horizontal locking groove of a neighbored panel, wherein the protruding lip of said neighbored panel has been removed.

5. The panel of claim 1 wherein the horizontal locking element retains the neighbored panel in vertical and/or horizontal direction.

6. The panel of claim 1 wherein at least two detachable protruding lips are fixed at the panel.

7. The panel of claim 1 wherein all front ends are protruded with respect to the circumference by a detachable protruding lip formed at the lower side.

8. The panel of claim 1 wherein a vertical locking groove is incorporated in the horizontal locking groove and the protruding lip comprises a vertical locking element being suitable for engaging in the vertical locking groove of a neighbored panel, wherein the protruding lip of said neighbored panel has been removed.

9. The panel of claim 1 wherein the panel comprises a material selected from a group consisting of MDF, HDF, cork, OSB, solid wood, plywood, plastics, cement fibers, basalt, rock wool, ceramics, genuine stone, metal, glass, plastics, chipboard, laminate floorboards, and mixtures or pairings thereof.

10. The panel of claim 1 wherein the panel has a rectangular shape, an quadratic shape or a shape of a parallelogram.

11. The panel of claim 1 wherein the protruding lip comprises a trough.

12. The panel of claim 1 wherein the predetermined break-off surface is formed by a start notch and an end notch.

13. The panel of claim 1 wherein the start notch is oriented in a vertical distance in a range from 0.1 to 10 mm above the upper lip surface for forming a crack gap.

14. The panel of claim 1 wherein the protruding lip comprises a material selected from a group consisting of MDF, HDF or plastics, and the core comprises a material selected from the group consisting of MDF, HDF or plastics.

15. The panel of claim 1 wherein: a decorative layer and/or an abrasion resistant layer is arranged on the upper side, and/or a layer for insulating footstep sounds and/or a counterdraw layer is oriented below the lower side.

16. A method for manufacturing wall, ceiling and/or floor coverings comprising a plurality of panels according to claim 1, wherein a first panel at a front end of the first panel is connected with the front end of a neighbored panel by removing the protruding lip at the predetermined break-off surface and by joining the protruding lip of the first panel with the horizontal locking groove of the neighbored panel.

17. The method of claim 16 wherein two neighbored panels are joined along their first sides of the two neighbored panels, in that a first side of a first panel is joined with a second side of a neighbored panel, wherein the upper male locking element or the lower male locking element of the neighbored panel, respectively, engage with the upper female locking element or the lower female locking element, respectively, of the first side of the first panel, in that the first second side of a first panel is joined with a second second side of a neighbored panel, wherein the upper male locking element of the first panel and the lower male locking element of the neighbored panel engage with the upper female locking element of the neighbored panel and the lower female locking element of the first panel.

18. The method of claim 17 wherein adhesive is provided for locking in the vertical direction.

19. The method of claim 17 wherein an adhesive or a glue is provided onto at least a part of the surface of the protruding lip for providing a locking function in the vertical direction or the adhesive or a glue is provided onto at least a part of the front end.

20. The method of claim 16 wherein the protruding lip of the first panel comprises at least one horizontal locking element being suitable for engagement in the horizontal locking groove of the neighbored panel, wherein the protruding lip of the neighbored panel has been removed, wherein during joining the horizontal locking element is incorporated in the horizontal locking groove.

* * * * *